US008590079B2

(12) United States Patent
Habegger

(10) Patent No.: US 8,590,079 B2
(45) Date of Patent: Nov. 26, 2013

(54) CUSHION FOR SUPPORTING PATIENTS AND FOR PREVENTING PRESSURE SORES

(75) Inventor: Daniel Habegger, Weiningen (CH)

(73) Assignee: Prospective Concepts AG, Dietikon (CH)

( * ) Notice: Subject to any disclaimer, the term of this patent is extended or adjusted under 35 U.S.C. 154(b) by 522 days.

(21) Appl. No.: 12/227,495

(22) PCT Filed: May 11, 2007

(86) PCT No.: PCT/CH2007/000237

§ 371 (c)(1),
(2), (4) Date: Jan. 16, 2009

(87) PCT Pub. No.: WO2007/140633

PCT Pub. Date: Dec. 13, 2007

(65) Prior Publication Data

US 2009/0265857 A1 Oct. 29, 2009

(30) Foreign Application Priority Data

Jun. 9, 2006 (CH) ..... 944/06

(51) Int. Cl.
*A47C 16/00* (2006.01)

(52) U.S. Cl.
USPC ..... 5/655.3; 5/655.7; 5/713; 5/729

(58) Field of Classification Search
USPC ..... 5/706, 707, 709, 710, 713, 714, 724, 5/726, 727, 729, 652.1, 652.2, 653, 654, 5/655.3, 655.9, 654.1, 711, 712; 297/452.41, 284.1; 267/117, 142, 143
See application file for complete search history.

(56) References Cited

U.S. PATENT DOCUMENTS 1,673,636 A * 6/1928 Perry ..... 267/117
5,113,539 A * 5/1992 Strell ..... 5/710
5,267,364 A 12/1993 Volk (Continued)

FOREIGN PATENT DOCUMENTS

DE 10122209 11/2002
EP 0261830 3/1988

(Continued)

OTHER PUBLICATIONS

Birlanga, Perez J, International Search Report for PCT/CH2007/000237 as mailed Aug. 17, 2007 (3 pages).

*Primary Examiner* — Nicholas Polito
(74) *Attorney, Agent, or Firm* — Winstead PC

(57) ABSTRACT

The cushion according to the invention is made up of several layers of pneumatic elements (3) which each form a matrix (2). These pneumatic elements (3) each have a multiplicity of holes (5*a*) into which elastic spring elements, for example foam cylinders (1), are inserted. The pneumatic elements (3) are all substantially congruent, such that the holes (5*a*) of superposed pneumatic elements (3) are in each case located at the same places. An individual pneumatic element (3) is produced from two superposed sheets of an elastic plastic. The two sheets are welded sealingly to each other at the edges of the cushion and at the edges of the holes (5*a*). The holes (5*a*) are cut out after the welding. Each pneumatic element (3) has at least one connection for compressed gas. While supporting a patient, the pneumatic elements (3) are alternately supplied with compressed gas and then relaxed again. This has the effect of changing the load of the patient from more on the pneumatic elements to more on the spring elements, and vice versa.

14 Claims, 3 Drawing Sheets a)

b)

c)

(56) References Cited

U.S. PATENT DOCUMENTS

| | | | | |
|---|---|---|---|---|
| 5,638,565 | A * | 6/1997 | Pekar | 5/710 |
| 5,640,728 | A | 6/1997 | Graebe | |
| 5,836,027 | A | 11/1998 | Leventhal et al. | |
| 6,592,533 | B1 | 7/2003 | Yonekawa et al. | |
| 6,739,008 | B1 * | 5/2004 | Kindrick | 5/655.9 |
| 6,973,690 | B2 * | 12/2005 | Muci et al. | 5/644 |
| 7,069,609 | B2 * | 7/2006 | Zheng | 5/654 |
| 7,089,618 | B1 * | 8/2006 | Metzger | 5/709 |
| 7,325,265 | B2 * | 2/2008 | Hornbach et al. | 5/618 |
| 2005/0229320 | A1 * | 10/2005 | Wu | 5/706 |
| 2006/0162087 | A1 * | 7/2006 | Chang | 5/724 |

FOREIGN PATENT DOCUMENTS

| | | |
|---|---|---|
| EP | 1307169 | 5/2003 |
| WO | WO-8602244 | 4/1986 |
| WO | WO-03028611 | 4/2003 |
| WO | WO-2004037148 | 5/2004 |

* cited by examiner

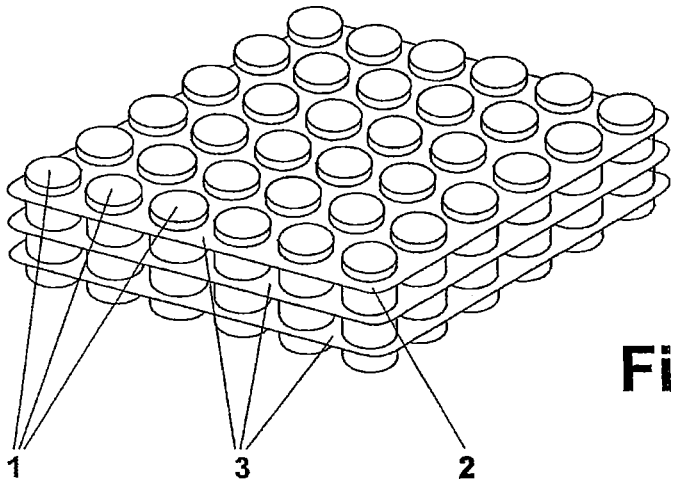
Fig. 1
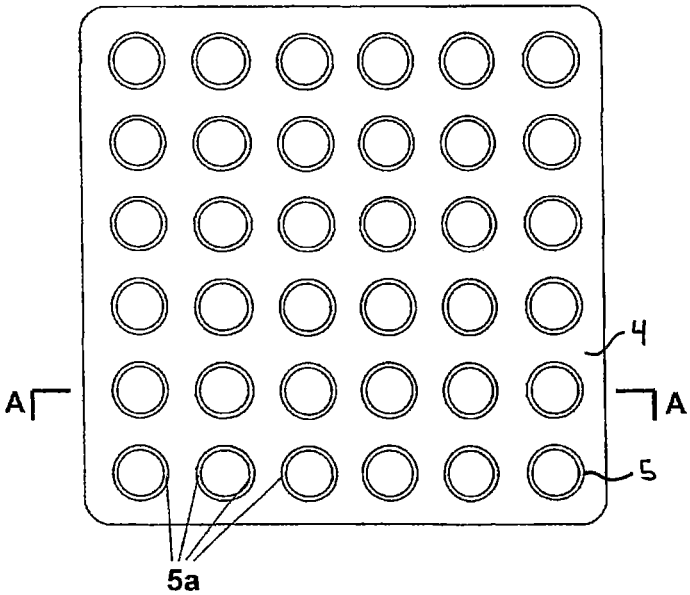
a)
Fig. 2
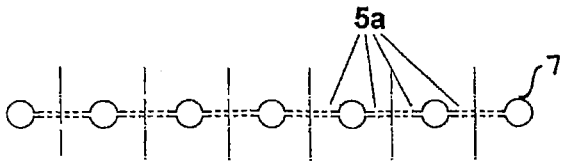
b)

CUSHION FOR SUPPORTING PATIENTS AND FOR PREVENTING PRESSURE SORES

BACKGROUND OF THE INVENTION

1. Technical Field

The present invention relates to a cushion and/or a bed overlay, for use in and on wheelchairs and, if constructed as a bed overlay, as a support for short- or long-term patients or as an operating table.

2. History of Related Art

Pressure sores occur as a result of lack of care, especially in the tissue where the patient's weight impairs the circulation of the respective tissue over a lengthy period of time predominantly via individual bones, for example the sacrum, ischia, trochanter. The recognized therapy of choice is either moving the lying patient to another bed or taking care, by apparatus-supported means, that the resting points of the lying or sitting body vary.

Several apparatus-based solutions have been produced in response to this requirement. Many of these solutions operate with transversely and/or longitudinally segmented mattresses for patients' beds. Here, the individual segments are filled alternatingly or rhythmically with a pressure medium—water or air—, and thus bring about changes and movements of the resting or sitting points. Such a bed—as an example of this group of solutions—is described in U.S. Pat. No. 5,267,364 (D1). In D1 a hospital bed is disclosed, which carries on a foam mattress an air mattress. This is segmented into a plurality of individual, transversely-running air pockets which each have an individual air connection and are filled with compressed air in a controllable sequence. Compared with the possible extent of the wounds of pressure sores, the segmenting is relatively crude and only takes place in the longitudinal dimension of the bed. The solution disclosed in D1 is not suitable for preferably seated patients, such as paraplegics or tetraplegics.

The solution known from EP 0 261 830 (D2) shows a refined segmenting of the air mattress compared with D1. The complexity in terms of apparatus as a whole is great and is correspondingly costly.

In U.S. Pat. No. 6,592,533 (D3) a massage bed is described, likewise relatively crudely segmented, where, however, a pressure sore of a patient is not to be given therapy or treated preventively; on the other hand, a changing support of the patient on air cushions and a padding with elastic fibres is envisaged.

EP 1 307 169 (D4) likewise describes a massage chair with a number of mechanically driven massage elements which are each surrounded by a ring-shaped cushion. The cushions are acted upon by a pressure fluid with a controlled pressure. The device is preferably constructed as a massage chair with massage elements also in the region of the thoracic vertebrae. The complexity in terms of apparatus is great and would scarcely be able to be integrated into a wheelchair.

Finally, from WO 2004/037 148 (D5) a cushion is known for the palliation of pressure sores, with a foam support onto which a fluid mattress is placed. This fluid mattress is divided into reciprocally fluid-tight strips. Several fluid pumps control the pressure and the frequencies of pressure change.

SUMMARY OF THE INVENTION

The object of the present invention is the provision of a cushion, as a lying or sitting cushion—which can effectively prevent the processes leading to pressure sores and can contribute to the palliation and healing of pressure sores which have occurred, and which can also be used for numerous further applications in medicine such as, for example, pain therapy or microstimulation; in addition, the problem which is to be solved is to solve the technical design with little weight, a small amount of air and good lateral stability without "floating" and with little complexity at a favourable cost.

BRIEF DESCRIPTION OF THE DRAWINGS

A more complete understanding of the cushion of the present invention may be obtained by reference to the following Detailed Description, when taken in conjunction with the accompanying Drawings, wherein:

FIG. 1 shows an isometric view of a first embodiment;

FIG. 2 shows a top view onto and a cross-section through a pneumatic element;

DETAILED DESCRIPTION OF ILLUSTRATIVE EMBODIMENTS OF THE INVENTION

Figure 3:
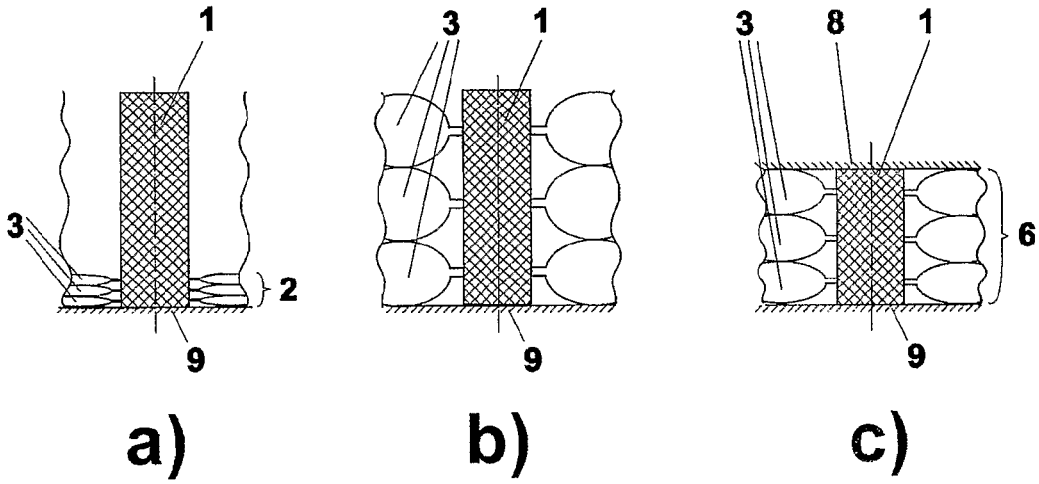
FIGS. 3*a*, 3*b*, 3*c* show a cross-section through an arrangement according to FIG. 1.

Various embodiments of the present invention will now be described more fully with reference to the accompanying drawings. The invention may, however, be embodied in many different forms and should not be construed as limited to the embodiments set forth herein; rather, the embodiments are provided so that this disclosure will be thorough and complete, and will fully convey the scope of the invention to those skilled in the art.

In the isometric view according to FIG. 1, the interior of the cushion according to the invention or of a part of a bed overlay, for example a mattress, is illustrated by way of example. A group of foam cylinders 1 is held by a multi-layered matrix 2 of pneumatic elements 3. The hardness of the foam which is used can thus be selected and adapted to the lying or sitting part of the body. If the cushion according to the invention is used as a seat cushion, for example in a wheelchair, then especially the ischial tuberosities of the patient are to be underlaid with a different hardness than for example the thighs. One of the pneumatic elements 3 is illustrated in FIGS. 2*a, b.*

FIG. 2*a* shows a top view, FIG. 2*b* a section AA. Two elastic sheets 4, for example of polyurethane or of another suitable plastic, are superposed and are welded to each other along ring-shaped contours (rings 5), then holes 5*a* are cut out, so that the foam cylinders fit if applicable with play into the holes 5*a*. The welding of the sheets 4 for a cushion can take place with a single tool. Instead of welding the sheets 4, these can also be glued with a suitable adhesive.

Several congruent pneumatic elements 3 can thus be superposed and form together a laminar linear pneumatic actuator 6. At least one connection for inflow and outflow for a pressure medium is provided per pneumatic element 3. On filling of the pneumatic element 3, the cavities produced between the sheets 4 form bubbles 7. When such a cushion, which is acted upon with pressure medium, is now stressed, then the shapes of the bubbles 7 change, as shown in FIG. 3*c*. A cut-out from such an actuator 6 is illustrated in the stressed state in FIG. 3.

FIG. 3*a* shows a foam cylinder 1 with the part which surrounds it of the matrix 2 of—here three—pneumatic elements 3 in the empty state.

In FIG. 3*b* the same arrangement is illustrated with the pneumatic elements 3 filled with compressed air, but in the unstressed state.

The stressed state is illustrated in FIG. 3*c* with a diagrammatically drawn laminar load 8. The foam cylinder 1 and the pneumatic actuators 6—consisting of the three pneumatic elements 3—respectively bear the part of the load 8 corresponding to their resiliences.

Both the matrix 2 and also correspondingly the number, size and hardness of the foam cylinders 1 can be adapted in a wide scope to the particular requirements of position, weight and size of the patient who is to be supported.

The idea of the invention, which forms the basis of the operation of such a cushion described up to now is as follows: The pneumatic elements 3 which are combined in the matrix 2 are acted upon with pressure by controllable air pressure or of another medium with a medically established amplitude and frequency and—preferably—partially relieved. Thereby, the locally resting load of the patient is distributed in an alternating manner once more onto the foam cylinders 1, once more onto the pneumatic elements 3. Through this changing loading of the sitting or resting tissue, the supply of this tissue and of the embedded nerves with blood and lymph is greatly improved. Such controls in amplitude and frequency of the compressed air which is supplied are known and are not the subject matter of this invention.

Figure 4:
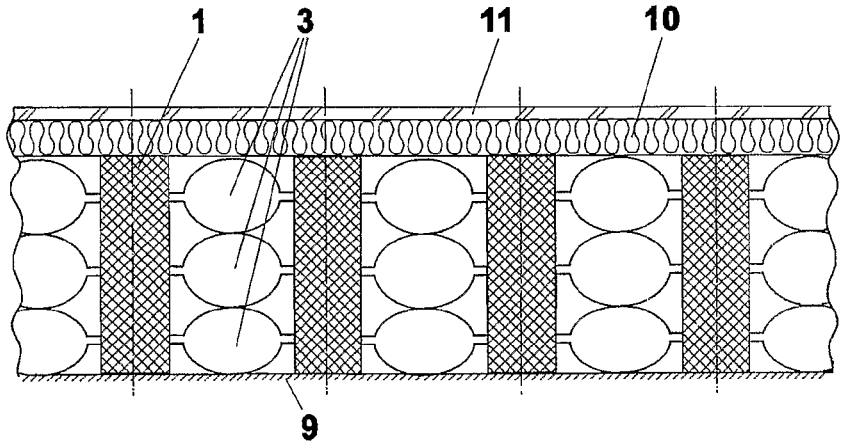
FIG. 4 shows a cut-out through a part of an embodiment with an addition.

In FIG. 4 an addition, in accordance with the invention, to the cushion shown partially in FIG. 3, is illustrated. The arrangement of foam cylinder 1 and pneumatic element 3 on an underlay 9 is covered by a spacer fabric 10, predominantly of monofil fibres and suitably fastened. Such spacer fabrics 10 are known and are commercially available. They have the characteristic of not collapsing even in the case of high surface loads, of having a large internal diameter compared with the cross-sectional area occupied by the monifil fibres, are flexible and easily able to be cut. The spacer fabric 10 is covered by a suitable cushion material 11. Owing to the large internal diameter, a transverse flow can be built up in this spacer fabric 10, indicated by a horizontal arrow in FIG. 4. The air which is used for such a transverse flow can be prepared in a small air-conditioning system—for example with Peltier elements. The air can flow in an open system or/and be recycled. Such air-conditioning systems are known from being used for automobiles. In addition or alternatively, the if necessary conditioned air can also be blown in or sucked out from below and can arrive through the annular gaps around the foam cylinders 1 upwards or downwards. Of course, it is also possible to provide one or more pneumatic elements 3 at suitable locations with small air holes such that the air-conditioning can be achieved through these air holes, with of course at the same time only as much air being allowed to escape or flow through that the pneumatic elements can continue to fulfil their function for receiving the load.

In FIGS. 1, 3, 4 respectively three pneumatic elements 3 are placed one over the other. Of course, a different, smaller or greater number can also be selected. Likewise, the diameters of the foam cylinders 1 are in no way compulsorily all identical. For different purposes of use—whether for a bed or for a seating surface—larger or smaller foam cylinders 1 or elastic volume bodies of suitable materials come into consideration, likewise different sizes let into one and the same matrix 2.

The production of the pneumatic elements 3 from two sheets 4 is relatively simple; individual weld dies can be simply exchanged and arranged in a different pattern. In addition, each pneumatic element on the cushion can of course be adapted to the anatomical/medical parameters and requirements, for example by the shape, size and number of elements. In particular, the pneumatic elements can be combined in groups or formed individually as separate air chambers and can also be controlled, filled and evacuated of air separately according to the application.

Figure 5:
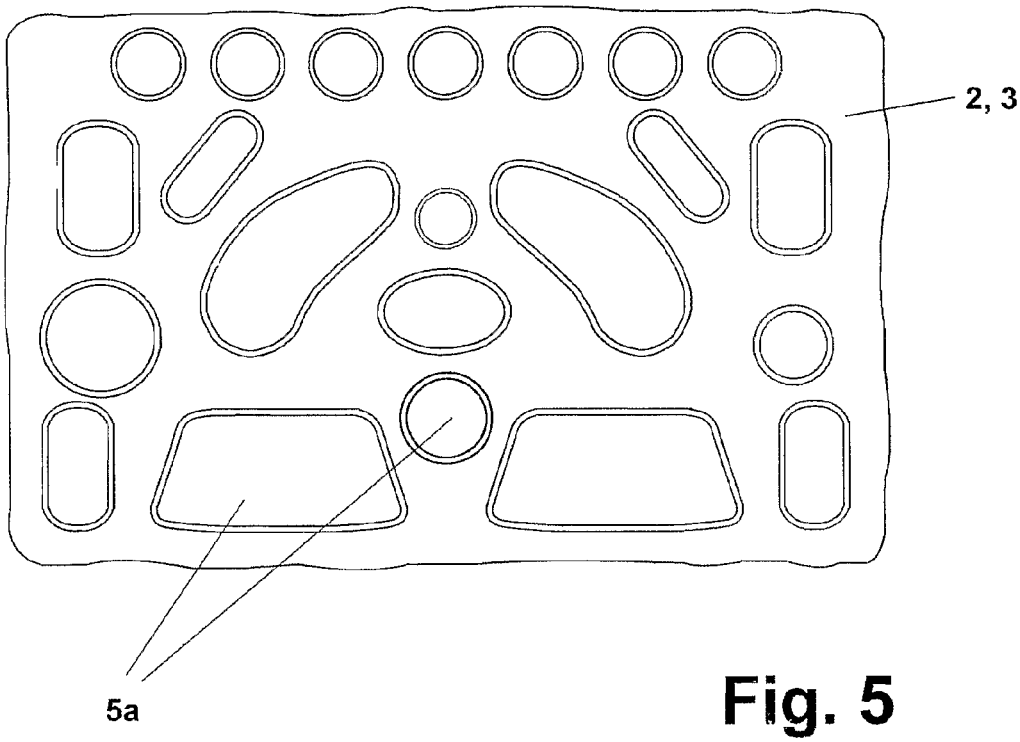
FIG. 5 shows a top view onto a second embodiment.

FIG. 5 is a top view onto a cut-out of a matrix of a second example embodiment. Here, the holes 5*a* are partly round, partly polygonal (with rounded corners), partially elongated and rounded. The production of such a matrix runs just as effected with regard to FIGS. 2*a, b*. Instead of foam cylinders 1, foam bodies, of course formed in an analogous manner to the holes 5*a*, are inserted into the non-round holes 5*a*. For all the example embodiments, it also applies that instead of foam, viscoelastic or viscoplastic volume bodies can be used according to the invention, likewise volume bodies 1*c* based on textiles. It is essential to the invention that the, foam cylinders 1, foam bodies, and volume bodies are passively yielding or elastic. They are combined under the designation of spring elements, which also includes viscoplastic bodies, in so far as they assume the original shape again after the load has been discontinued. The resiliences of these spring elements can be chosen and set for the individual requirements and the individual case of application.

Likewise, not only a rectangle which is divided into fields and elements in a regular and symmetrical manner applies as a matrix in terms of the invention described here, but in a broad sense the matrix also means all regular and irregular and symmetrical and also non-symmetrical arrangements of holes 5*a* and hence of spring elements 15 on a limited area.

The amount of air required for operating the pneumatic elements 3 is small and allows a rapid and momentary reaction to the sensitivity of patients compared with known pneumatic mattresses and cushions.

Although various embodiments of the present invention have been illustrated in the accompanying Drawings and described in the foregoing Detailed Description, it will be understood that the invention is not limited to the embodiments disclosed, but is capable of numerous rearrangements, modifications and substitutions without departing from the spirit of the invention as set forth herein.

The invention claimed is:

1. A cushion for supporting a patient comprising:

a plurality of pneumatic elements;

each pneumatic element of the plurality of pneumatic elements comprising a matrix which is adapted to be filled with a pressure medium and has a plurality of holes with sealingly welded contours;

a plurality of spring elements, wherein each spring element of the plurality of spring elements is inserted into a hole of the plurality of holes;

a controller that regulates an amplitude and a frequency of the pressure medium within the plurality of pneumatic elements for periodically distributing a resting weight of the patient from the plurality of pneumatic elements onto the plurality of spring elements and from the plurality of spring elements onto the plurality of pneumatic elements, thereby changing a loading area on a tissue of the patient;

wherein at least two substantially congruent matrices are superposed such that on filling of the plurality of pneumatic elements with the pressure medium, the resting weight of the patient is supported by the plurality of pneumatic elements and the plurality of spring elements more at points where the patient stresses the plurality of pneumatic elements; and wherein, during a charge or discharge of the plurality of pneumatic elements, the plurality of pneumatic elements move relative to the plurality of spring elements.

2. The cushion according to claim 1, wherein the plurality of holes are substantially circular.

3. The cushion according to claim 1, wherein the plurality of spring elements comprise at least one of foam, viscoelastic, viscoplastic elements, or an elastic textile.

4. The cushion according claim 1, wherein the plurality of holes are equal in number to the plurality of spring elements.

5. The cushion according to claim 1, wherein the plurality of pneumatic elements in the matrix can be filled with air and emptied individually.

6. The cushion according to claim 1, wherein the plurality of holes are arranged regularly in the matrix.

7. The cushion according to claim 1, wherein a hardness and an elasticity of the plurality of spring elements is varied according to a location of each spring element relative to a body of the patient.

8. The cushion according to claim 1, wherein an active area of the matrix substantially coincides with an area of the plurality of spring elements.

9. The cushion according to claim 1, wherein:

each pneumatic element of the plurality of pneumatic elements comprise two elastic sheets; and wherein each pneumatic element of the plurality of pneumatic elements are connected sealingly with each other such that bubbles are produced between a linear connection point and a connection point forming a ring around the hole of the plurality of holes.

10. The cushion according to claim 9, wherein the two elastic sheets are connected to each other by gluing.

11. The cushion according to claim 9, wherein the two elastic sheets are connected to each other by welding.

12. The cushion according to claim 1, wherein a spacer fabric is laid onto an uppermost matrix.

13. The cushion according to claim 1, wherein the matrix comprises at least one connection for the pressure medium.

14. The cushion according to claim 1, wherein the plurality of pneumatic elements in the matrix can be filled with air and emptied in groups.

* * * * *

UNITED STATES PATENT AND TRADEMARK OFFICE

CERTIFICATE OF CORRECTION

PATENT NO. : 8,590,079 B2
APPLICATION NO. : 12/227495
DATED : November 26, 2013
INVENTOR(S) : Daniel Habegger It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 667 days.

Signed and Sealed this
Twenty-second Day of September, 2015

Michelle K. Lee

Michelle K. Lee
*Director of the United States Patent and Trademark Office*